US007178273B2

(12) United States Patent
Arzberger

(10) Patent No.: US 7,178,273 B2
(45) Date of Patent: Feb. 20, 2007

(54) CUTTING DEVICE FOR CUTTING TRENCHES IN THE GROUND

(75) Inventor: Maximilian Arzberger, Igenhausen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 10/786,601

(22) Filed: Feb. 26, 2004

(65) Prior Publication Data

US 2005/0000123 A1 Jan. 6, 2005

(30) Foreign Application Priority Data

Feb. 27, 2003 (DE) ..... 103 08 539

(51) Int. Cl.
*E02F 3/24* (2006.01)

(52) U.S. Cl. ..... 37/189; 37/365

(58) Field of Classification Search ..... 37/189, 37/348, 364, 365, 91, 462, 94, 198, 352; 175/91

See application file for complete search history.

(56) References Cited

U.S. PATENT DOCUMENTS 3,710,878 A * 1/1973 Endo et al. ..... 175/66
3,894,587 A * 7/1975 Sourice ..... 175/91
4,009,531 A * 3/1977 Metrier ..... 198/509
4,057,139 A * 11/1977 Mausolf et al. ..... 198/509
4,120,106 A * 10/1978 Smith et al. ..... 37/190
4,312,541 A * 1/1982 Spurgeon ..... 299/31
4,445,608 A * 5/1984 Evans et al. ..... 198/509
4,561,198 A * 12/1985 Holley ..... 37/104
4,662,684 A * 5/1987 Marten ..... 299/1.5
4,694,915 A * 9/1987 Bauer et al. ..... 175/91
4,785,559 A * 11/1988 Hentschel ..... 37/94
4,930,940 A * 6/1990 Charlier et al. ..... 405/267
5,035,071 A 7/1991 Stötzer
5,092,659 A * 3/1992 Grathoff ..... 299/39.2
5,810,449 A * 9/1998 Grathoff ..... 299/39.8
5,924,222 A 7/1999 Stoetzer
5,964,305 A 10/1999 Arzberger et al.
2004/0234345 A1 11/2004 Arzberger

OTHER PUBLICATIONS

Dictionary of Construction at http://ww.explore-construction.com/cgi-bin/find.cgi results of search for "trench wall cutter" May 11, 2005.*

* cited by examiner

*Primary Examiner*—Thomas B. Will
*Assistant Examiner*—Jamie L. Oswald
(74) *Attorney, Agent, or Firm*—Jacobson Holman PLLC

(57) ABSTRACT

A cutting device for cutting trenches in the ground having at least one cutting wheel drivable in rotary manner and at least one first cutting element, located on the cutting wheel, for removing soil material during a rotation of the cutting wheel in one rotation direction. On said cutting wheel is provided at least one second cutting element for removing soil material in an oppositely directed, second rotation direction, at least one of the cutting elements is displaceably mounted between a first position for removing soil material and a retracted, second position and a control device is provided for the displacement of the cutting element between the first and second positions.

14 Claims, 3 Drawing Sheets

CUTTING DEVICE FOR CUTTING TRENCHES IN THE GROUND

Figure 1:
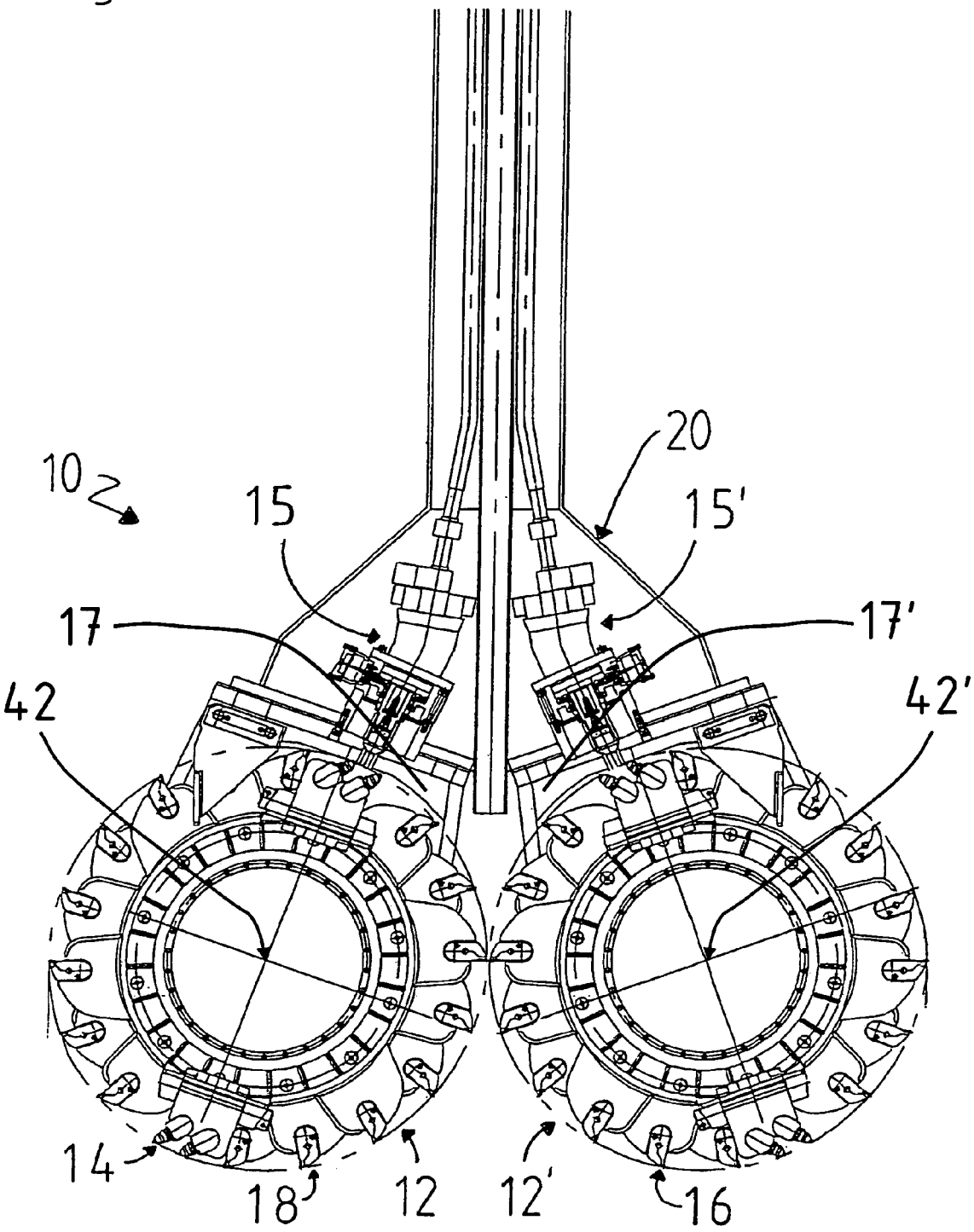

The invention relates to a cutting device for cutting trenches in the ground. Such a cutting device has at least one cutting wheel which can be driven in rotary manner and at least one first cutting element located on the cutting wheel for removing soil material during a rotation of the cutting wheel in a first rotation direction.

Such a cutting device is known from DE 37 15 977 C2. In this known cutting device fixed cutting teeth are circumferentially located on a cutting wheel and are used for removing outcropping soil material during a rotation of the cutting wheel. There are also pivotable hinged teeth on the cutting wheel and in a swung out position they engage in soil material positioned upstream of the bearing plate of the cutting wheel. The cutting teeth are so arranged on the cutting wheel that their cutting action is only optimized for a specific rotation direction.

The object of the invention is to provide a cutting device of the aforementioned type which can be used as universally as possible.

According to the invention this object is achieved by a cutting device for cutting trenches in the ground, having at least one cutting wheel drivable in rotary manner and at least one first cutting element, located on the cutting wheel, for removing soil material during a rotation of the cutting wheel in a first rotation direction. Such a cutting device is characterized in that on the cutting wheel is provided at least one second cutting element for removing soil material in an oppositely directed, second rotation direction, that at least one of the cutting elements is displaceably mounted between a first position for removing soil material and a retracted second position and that a control device is provided for displacing the cutting element between the first and second positions.

A fundamental idea of the invention is to provide both a first cutting element and a second cutting element on the cutting wheel rotatable about a rotation axis, the first cutting element removing soil material outcropping at the cutting wheel during a rotation of the latter in a first rotation direction, whereas the second cutting element removes such soil material during a rotation of the cutting wheel in an oppositely directed, second rotation direction. At least one of the cutting elements is displaceably mounted by a control device between a first position in which it can remove soil material on the trench wall and a retracted, second position in which preferably no soil working takes place. Preferably the cutting elements are successively arranged in a circumferential direction of the cutting wheel. Preferably the displaceably mounted cutting element is positioned in such a way that at least a part thereof in the first position is radially further spaced from the rotation axis of the cutting wheel than in the second position. In particular, the cutting elements are positioned in such a way that the displaceably mounted cutting element in the first position at least partly projects with respect to the in each case other cutting element in a radial direction of the cutting wheel, whereas in the second position the in each case other cutting element at least partly radially projects compared with the displaceable cutting element. As a result and as a function of the position of the displaceable cutting element, either the displaceable cutting element or the other cutting element works the soil on the trench wall. This creates a particularly universally usable cutting wheel.

The displacement of the displaceably mounted cutting element preferably takes place as a function of the rotation direction of the cutting wheel. If the first cutting element is displaceable, displacement preferably takes place in such a way that the first cutting element during a rotation of the cutting wheel in a first rotation direction is in the first position for removing soil material, whereas during a rotation in the oppositely directed, second rotation direction it is in the retracted, second position. If the displaceably mounted cutting element is the second cutting element, preferably during a rotation in the second rotation direction it is brought into the first position. Such a rotation direction-dependent displacement makes it possible during a reversing rotation of the cutting wheel to ensure that only the cutting element provided for the particular rotation direction is in contact with the trench wall and removes soil material there. However, the in each case other cutting element is in the retracted position, where it is protected against the action of the generally very hard soil material to be removed. This permits an operation of the cutting wheel with a good cutting capacity in both rotation directions and simultaneously excessive cutting element wear is avoided.

A preferred development of the cutting device according to the invention is characterized in that the first cutting element and the second cutting element are displaceable. This leads to a particularly flexibly usable cutting device. Preferably, through the control device, during the displacement of the first cutting element, the second cutting element is displaceable into the other position. This ensures that during cutting only one of the cutting elements is in the first position for removing soil material, whereas the other cutting element is retracted into the protected, second position.

A preferred cutting device is also characterized in that the control device has a drive for the displacement of the cutting element. Such a drive can e.g. be constructed as a hydraulic, rack and pinion or cam control drive. In particularly preferred manner the control device is operable by a force exerted by the outcropping ground during rotary operation. The force can in particular be a frictional force, which occurs between at least one of the cutting elements and the outcropping ground and/or between the control device and the outcropping ground. This leads to a particularly reliable rotation direction-dependent displacement of the cutting elements.

In a particularly preferred cutting device, the control device has at least one pivoted lever constructed on a circumferential surface of the cutting wheel. The pivoted lever preferably has a pivot axis parallel to a rotation axis of the cutting wheel. Preferably the pivoted lever is constructed symmetrically to the pivot axis and in particular in mirror symmetrical manner to a plane passing through the pivot axis. Preferably the first and second cutting elements are arranged pairwise on the pivoted lever. Preferably the cutting elements are arranged symmetrically to the pivot axis and in particular in mirror symmetrical manner to a plane passing through the pivot axis. Such an arrangement leads to a particularly reliable alternate displacement of the cutting elements located on the pivoted lever. Preferably the pivoted lever is pivoted in rotation direction-dependent manner by a frictional force between the cutting elements and the outcropping ground occurring during cutting wheel rotation.

A particularly preferred cutting device is characterized in that the pivoted lever has at least one stop, which for limiting a control path of the pivoted lever engages on a circumferential surface of the cutting wheel.

The cutting elements can be studs or cutting rolls. However, in particularly preferred manner at least one of the cutting elements is a cutting tooth with a unilaterally constructed cutting edge. Such a cutting element ensures a high cutting action and simultaneously a good transport along the trench wall of the soil material removed.

In the case of a particularly preferred trench wall cutter a random number of cutting wheels is provided and have parallel rotation axes. A particularly preferred embodiment has four cutting wheels, whereof in each case two are arranged pairwise in rotary manner about the same rotation axis. A cross-section of the trench in the ground is preferably rectangular.

The invention is described in greater detail hereinafter relative to preferred embodiments and the attached diagrammatic drawings, wherein show:

FIG. 1 is a part sectional front view of a cutting device.

Figure 1A:
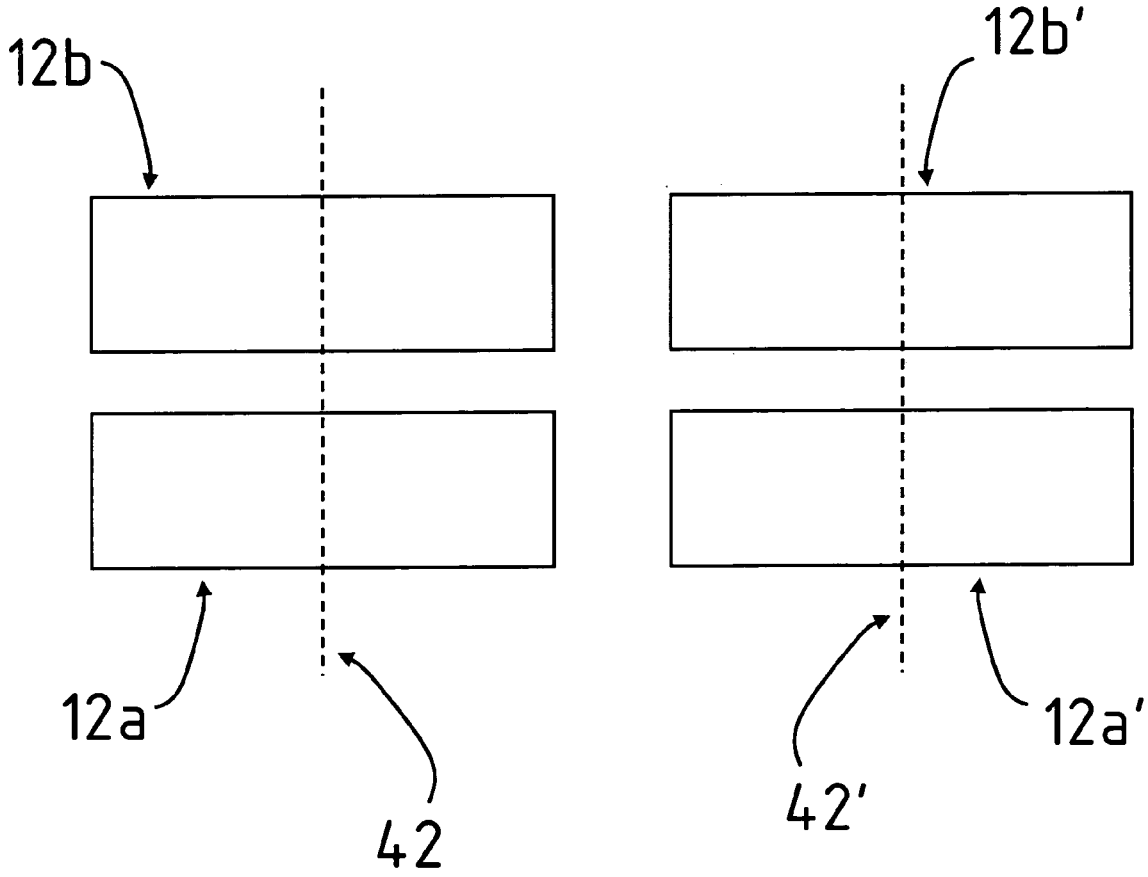

FIG. 1*a* is a diagrammatic, bottom plan view of the cutter wheels of the cutting device.

Figure 2:
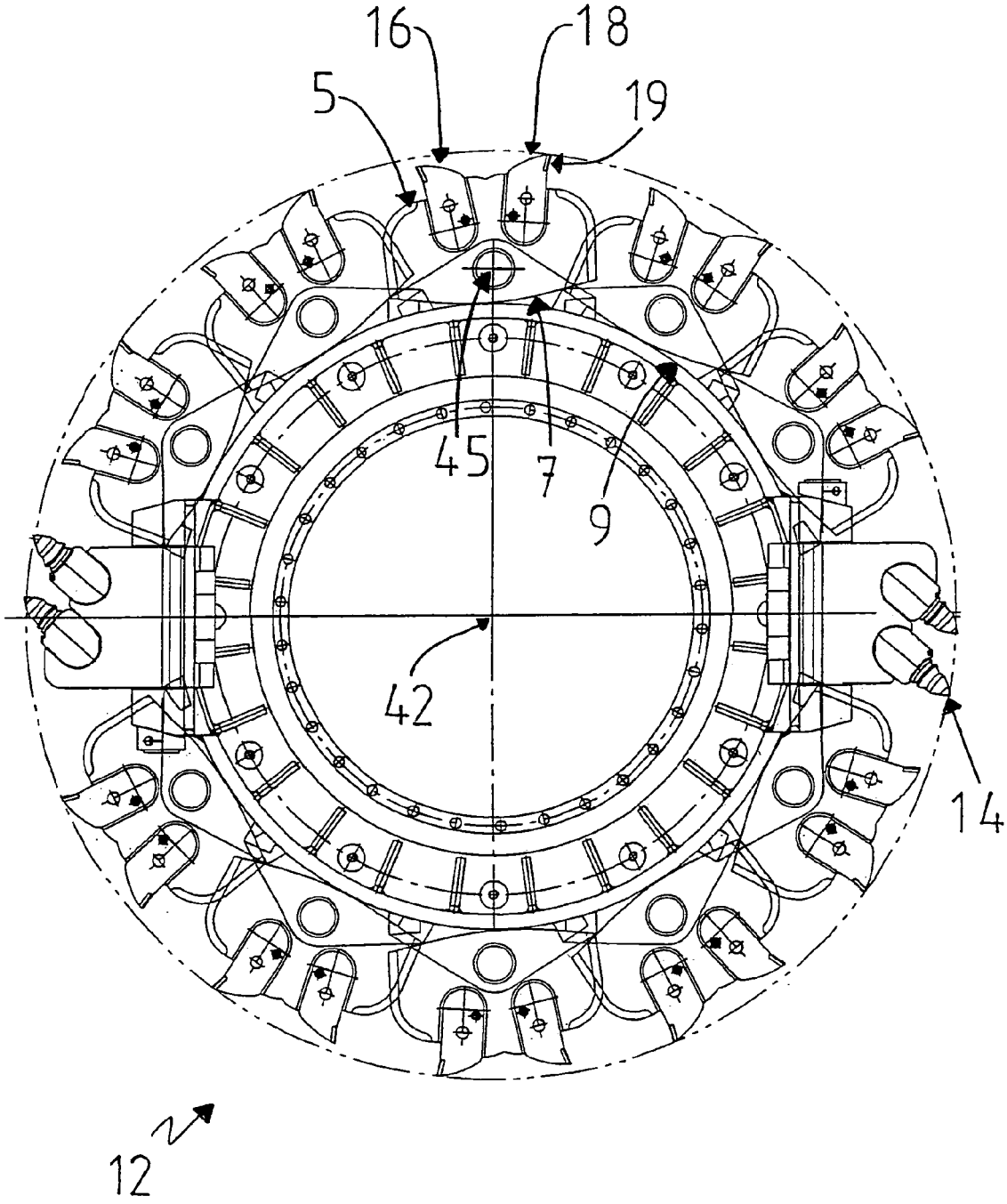

FIG. 2 is a front view of a cutting wheel according to the present invention.

FIG. 1 is a front view of an embodiment of a cutting device. By means of bearing plates 17, 17' two cutting wheels 12, 12' are fixed in rotary manner to a frame 20 constructed as a support plate. The cutting wheels 12, 12' are constructed in directly juxtaposed manner with parallel rotation axes 42 and 42'. To the frame 20 are fixed hydraulic motors 15, 15' for driving the cutting wheels 12, 12' and are operatively connected thereto.

In the case of a particularly preferred trench wall cutter, a random number of pairs of cutting wheels is provided and have parallel rotation axes 42, 42'. A particularly preferred embodiment has four cutting wheels 12*a*, 12*b*, 12*a*', 12*b*', whereof in each case two are arranged pairwise (12*a*, 12*b* and 12*a*', 12*b*') in rotary manner about the same rotation axis (42 and 42', respectively), as shown in FIG. 1A.

First cutting elements 16 and second cutting elements 18, constructed as unilaterally cutting teeth, are located on the cutting wheels 12, 12' and so as not to overburden representation only one type of cutting element 16, 18 is shown. In addition, laterally pivotable hinged teeth 14 are arranged circumferentially on the cutting wheels 12, 12' and strip the soil below the bearing plates 17, 17'.

FIG. 2 shows an embodiment of an inventive cutting wheel 12. First and second cutting elements 16, 18 are displaceably positioned on the pivoted lever 5. In the state shown in FIG. 2 the second cutting element 18 is in a first position for removing soil material, whereas the cutting element 16 is in a retracted, second position. In this position the second cutting element 18 projects radially over and beyond the first cutting element 16. Such an arrangement is provided for removing soil material when the cutting wheel is rotated clockwise.

The first and second cutting elements 16, 18 are designed as unilaterally cutting teeth and are provided with a cutting edge 19. They are in each case connected by means of two fixing points to the pivoted lever 5.

The pivoted lever 5 is pivotably articulated on the cutting wheel 12 about a pivot axis 45. The pivot axis 45 runs parallel to a rotation axis 42 of the cutting wheel 12. On the side remote from the cutting elements 16, 18 the pivoted lever 5 has a stop 7 constructed as a stop face. In the represented operating state for clockwise rotation the stop face on the left-hand side of the pivot axis 45 engages on a circumferential surface 9 of the cutting wheel 12. The pivoted lever 5 and both the first and second cutting elements 16, 18 are constructed in mirror symmetrical manner to a mirror plane passing through the pivot axis 45. The stop face forming the stop 7 has an arcuate cross-section.

On the circumference of the cutting wheel 12 shown in FIG. 2 there are ten similar pivoted levers 5.

The invention claimed is:

1. A trench wall cutter comprising:

trench cutting means for cutting trenches of rectangular cross-section in the ground in order to carry out underground construction work, the trench cutting means including:

first, second, third, and fourth cutting wheels drivable in rotary manner in first and second oppositely directed rotation directions, wherein the first and second cutting wheels are arranged in a first pair in rotary manner about a first common rotation axis, the third and fourth cutting wheels are arranged in a second pair in rotary manner about a second common rotation axis, and the first and second common rotation axes are parallel to each other, at least one first cutting means, located on each cutting wheel, for removing soil material during a rotation of the cutting wheel in a first rotation direction, and at least one second cutting means, located on each cutting wheel, for removing soil material during rotation of the cutting wheel in an oppositely directed, second rotation direction, at least one of the cutting means on each cutting wheel being displaceably mounted between a first position for removing soil material and a retracted, second position and control means for displacing the cutting means between the first position and the second position.

2. The trench wall cutter according to claim 1, wherein the first cutting means and the second cutting means are displaceable.

3. The trench wall cutter according to claim 2, wherein the second cutting means can be displaced into the other position by the control means during the displacement of the first cutting means.

4. The trench wall cutter according to claim 1, wherein the control means is operable by a force exerted by the outcropping ground during rotary operation.

5. The trench wall cutter according to claim 1, wherein the control means has at least one pivoted lever positioned on a circumferential surface of the cutting wheel.

6. The trench wall cutter according to claim 5, wherein the pivoted lever has a pivot axis provided parallel to a rotation axis of the cutting wheel.

7. The trench wall cutter according to claim 5, wherein the pivoted lever is constructed symmetrically to the pivot axis.

8. The trench wall cutter according to claim 5, wherein the first and second cutting means are arranged pairwise on the pivoted lever.

9. The trench wall cutter according to claim 5, wherein the pivoted lever has at least one stop which engages on a circumferential surface of the cutting wheel for limiting a control path of the pivoted lever.

10. The trench wall cutter according to claim 1, wherein at least one of the cutting means is a cutting tooth with a unilaterally formed cutting edge.

11. The trench wall cutter according to claim 1, further comprising a frame and bearing plates, wherein the cutting wheels are fixed in rotary manner to the frame by respective bearing plates.

12. The trench wall cutter according to claim 11, wherein the frame is constructed as a support plate.

13. The trench wall cutter according to claim 11, wherein the cutting wheels include laterally pivotable hinged teeth arranged circumferentially thereon for stripping the soil below the bearing plates.

14. A trench wall cutter comprising:

trench cutting means for cutting trenches of rectangular cross-section in the ground in order to carry out underground construction work, the trench cutting means including:

first, second, third, and fourth cutting wheels drivable in rotary manner in first and second oppositely directed rotation directions, wherein the first and second cutting wheels are arranged in a first pair in rotary manner about a first common rotation axis, the third and fourth cutting wheels are arranged in a second pair in rotary manner about a second common rotation axis, and the first and second common rotation axes are parallel to each other, at least one first cutting means, located on each cutting wheel, for removing soil material during rotation of the cutting wheel in a first rotation direction, and at least one second cutting means, located on each cutting wheel, for removing soil material during rotation of the cutting wheel in an oppositely directed, second rotation direction, at least one of the cutting means on each cutting wheel being displaceably mounted between a first position for removing soil material and a retracted, second position and control means for displacing the cutting means between the first position and the second position.

* * * * *